US006088002A

United States Patent [19]

Johnson et al.

[11] Patent Number: 6,088,002

[45] Date of Patent: Jul. 11, 2000

[54] ANTENNA SYSTEM

[75] Inventors: Torbjorn Johnson; Jan Berglund, both of Jarfalla, Sweden

[73] Assignee: Radio Design Innovation TJ AB, Kista, Sweden

[21] Appl. No.: 09/147,215

[22] PCT Filed: Mar. 24, 1997

[86] PCT No.: PCT/SE97/00500

§ 371 Date: Dec. 29, 1998

§ 102(e) Date: Dec. 29, 1998

[87] PCT Pub. No.: WO97/41622

PCT Pub. Date: Nov. 6, 1997

[30] Foreign Application Priority Data

Apr. 29, 1996 [SE] Sweden ..... 9601614

[51] Int. Cl.[7] ..... H01Q 1/12

[52] U.S. Cl. ..... 343/878; 343/799; 343/838; 343/890; 343/912; 52/111

[58] Field of Search ..... 343/793, 795, 343/799, 815, 817, 834, 836, 835, 838, 846, 878, 879, 890, 891, 912; 52/111, 114, 121

[56] References Cited

U.S. PATENT DOCUMENTS

| | | | |
|---|---|---|---|
| 2,577,469 | 12/1951 | Kumpf . | |
| 2,954,559 | 9/1960 | Yurek et al. | 343/875 |
| 3,836,977 | 9/1974 | Wheeler . | |
| 4,405,928 | 9/1983 | Elsbernd . | |
| 5,200,759 | 4/1993 | McGinnis | 343/890 |
| 5,204,688 | 4/1993 | Loiseau et al. | 343/890 |
| 5,418,545 | 5/1995 | Pantsios et al. | 343/795 |

FOREIGN PATENT DOCUMENTS

| | | |
|---|---|---|
| 1626297 | 2/1991 | U.S.S.R. . |

*Primary Examiner*—Don Wong
*Assistant Examiner*—Tho Phan
*Attorney, Agent, or Firm*—Oblon, Spivak, McClelland, Maier & Neustadt, P.C.

[57] ABSTRACT

An antenna system including a support structure and an antenna assembly having an open grid reflector structure in a closed ring and dipole elements. The antenna assembly includes a number of antenna panels, each including a number of the dipole elements, the closed ring is self-supporting and connected to the support structure by radial beams and struts, and the antenna panels are interconnected by a variable angle connection.

44 Claims, 9 Drawing Sheets

ANTENNA SYSTEM

BACKGROUND OF THE INVENTION

1. Field of the Invention

The present invention relates to a novel antenna system having increased capacity, easy assembly, fewer parts, high strength and the capability of enduring high wind-loads and low temperatures. This is accomplished by an antenna system comprising a closed ring of antenna panels supporting multiple lobes. The antenna system has a modular structure with exchangeable parts for economical transportation and manufacturing. The antenna system is easily adaptable to various conditions. The structural parts have an aerodynamic design and possible de-icing means for enduring severe climatic conditions.

The invention is related to the following patent applications with the same filing date as the present application or to be filed in the near future, having the same owner as the present application and entitled:

METHOD AND ARRANGEMENT OF CONVERTING A CELLULAR TELECOMMUNICATION SYSTEM;

ROTATING LOBE ACCESS METHOD;

SELF-SUPPORTING RADIO BASE STATION;

2. Discussion of the Background

The technological status of the analog cellular mobile telephony standard of today has a history going back to the late 70-ies. The present technology is a development of the systems from the early days.

The base stations are mostly omnidirectional sites (circular cells) or trisector sites (3×1200 cells). At the time of design it was considered to be enough with this cell structure. The antennas used are omnidirectional or 60° sectorized antennas with low antenna gain requiring high power RF (Radio Frequency) transmitters in both the base station and in the mobile unit.

Existing cellular sites typically have 3 sides and each side has two receiving and two transmitting antennas spread out at a width of typically 3–6 meters, but each antenna and cell radio is only getting an effective use of 0.3×2.5 m with a width/height (W/H) ratio of 0.10–0.25. Thus only three different lobes and cells cover the horizon.

For a high capacity cellular antenna system it is much more important that the antenna has a wide diameter (=width) than it has height. Traditional cellular antennas typically are 0.3 m wide and 2.5–3.5 m high at 800/900 MHz or 0.7 m wide at 450 MHz and supports one 60° lobe and a 120° wide cell.

Thus, the prior art antenna systems typically have is high power consumption, high back lobes and high interference levels due to the reasons stated above.

SUMMARY OF THE INVENTION

The present invention proposes an antenna system having a ring antenna modular principle consisting of coupled grid panel reflector antennas having low back lobes, very high gain and capacity and low wind drag.

The invention and further developments of the invention are set out in detail in the accompanying claims.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

Figure 1:
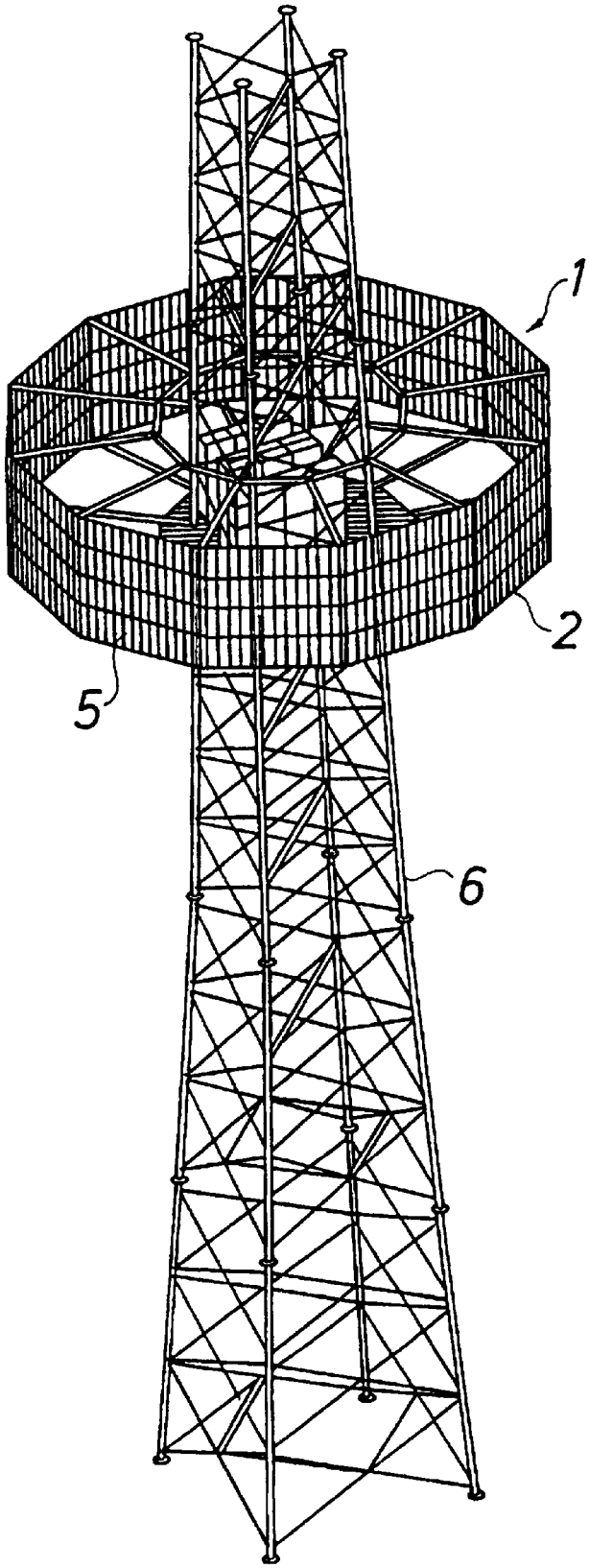
FIG. 1 is an overall view of a mast provided with a phased array antenna in accordance with the invention.

Referring now to the drawings, wherein like reference numerals designate identical or corresponding parts throughout the several views, and more particularly to FIGS. 1–10 thereof, there are illustrated embodiments of the present invention, as will now be described.

The present inventors have realized that the available frequency spectrum may be used more efficiently through installation of phased array antennas. The phased array antennas will enable the use of multiple lobes (from 8 to 100 or more per site). Each lobe can be treated as a cell which will make it possible to more effectively reuse the available frequency channels. The capacity can be further increased if the higher antenna gain in the phased array antennas is used to allow for a decrease of transmitted RF cower from both the mobile terminals and the base with a factor of 2–40 depending on antenna gain and sectorisation in the system.

The antenna system is modular and can be configured by:Number of panels 1–20 for maximum gain and directionality. Mast or building mounted reflector variants with different environmental backlobe and wind loads. Vertical height and gain variations 2–4–(6) dipoles. Different dipole row variants for: frequency, bandwidth (BW), lobe tilt, null fill up, connector location, wind area.

All variants have the same fixing holes and location and are thus selectable at installation or modifiable after installation if the network structure or traffic demand changes considerably. Also one dipole row can be removed for repair or upgrading without interrupting the operation, causing only minor performance loss.

Existing masts/towers are surveyed in order to collect structural data and locate available space for the new antennas. The collected data is used for planning of the antenna installation at each site.

After one of the reflector types and maximum possible quantity of panels have been determined and selected to suit the available tower strength and desired traffic, the best suitable dipole rows are selected. It may turn out that in different directions, the requirements vary with different capacity or range or beam tilts and different reflectors are optimum and possible. Dipole row variants can be selected and installed separately.

In the new antenna system each radio has coherent signal access to almost the full width of all antenna panels pointing to the actual subscriber. W=2.5–15 m and H=2.5–1.25 m gives a W/H ratio of 1.0–12.

Figure 2:
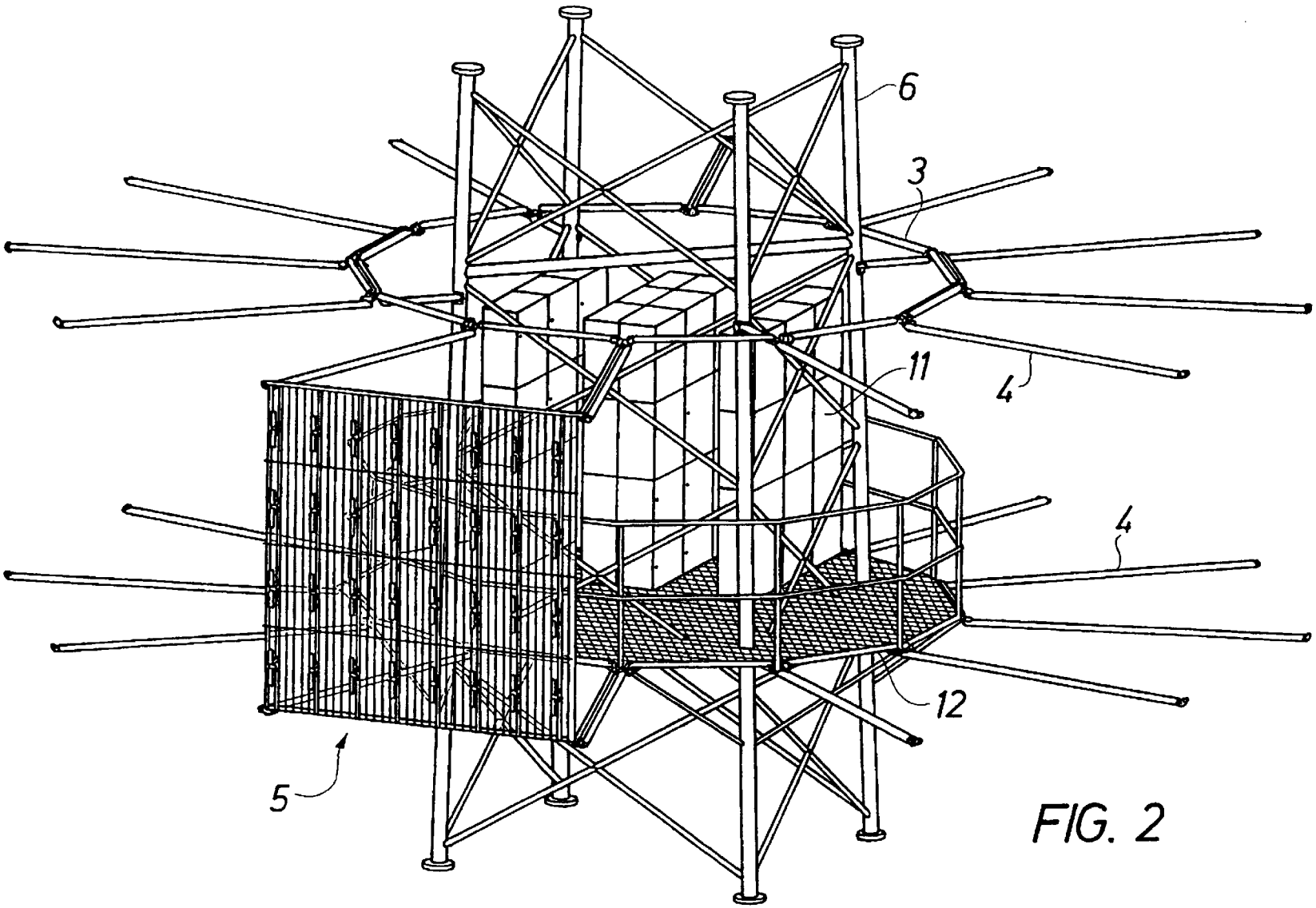
FIG. 2 is a cutaway view of a panel of the antenna and its mounting arrangement to the mast.

In FIGS. 1 and 2 a mast fitted with the antenna system of the present invention is shown. A mast may be an old mast having an old antenna system (not shown) and the present antenna system may be installed without interrupting the traffic of the old antenna. As may be seen from FIG. 1, the antenna system 1 comprises a closed outer ring 2 of panels 5 or sections. This outer ring 2 of panels 5 is connected to an inner ring 3 by horizontal beams or struts 4. The inner ring 3 is in turn connected to the mast 6.

Figure 3:
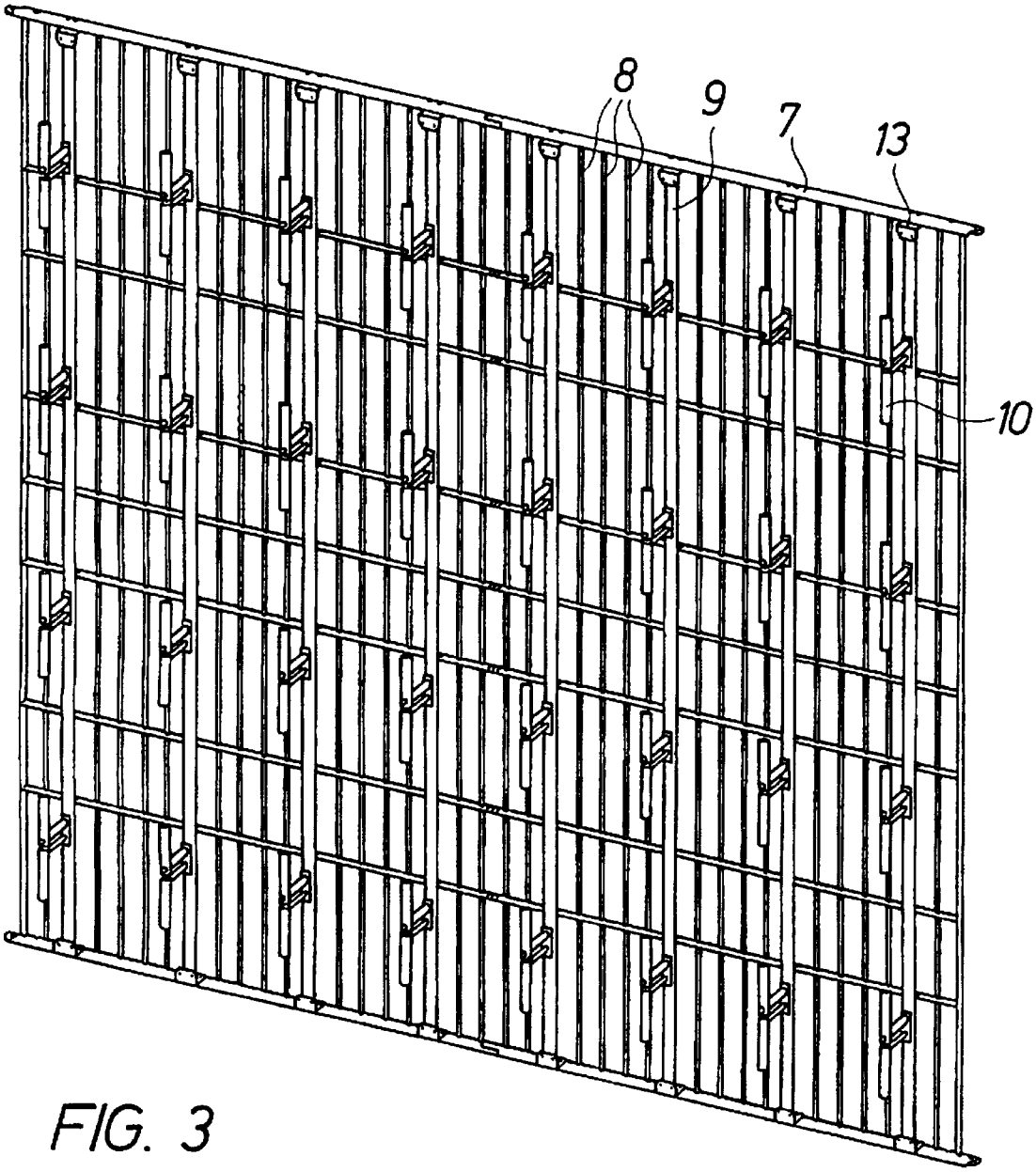
FIG. 3 is a perspective view of a panel of the phased array antenna in accordance with the invention.

FIG. 2 is a cutaway view with only one panel shown for better clarity. With reference also to FIG. 3, the panel consists of horizontal beams 7, vertical grid rods 8 and vertical transformer beams 9 on which dipole elements 10 are mounted. The panels are interconnected by upper and lower connections which are described more in detail below. The horizontal supporting struts 4 are connected to the inner ring 3 by upper and lower connections, which are also described more in detail below. Inside the inner ring a number of low wind area antenna boxes 11 are fixed to a floor 12. The antenna boxes 11 contain duplex filters (DPX), low noise amplifiers, transmitter power amplifiers and combiners as well as lobe-shaping och distributing equipment. The design and structure of the antenna boxes and the equipment associated therewith do not form any part of the present invention.

As an alternative, the antenna boxes may be located on the ground if the mast is low.

The antenna is almost self supporting by its horizontal and vertical members leading to the four bolted corner joints and to its neighbour.

The panel ring can be supported vertically to the mast structure by diagonal thin wires (not shown) having low wind area and weight, similar to a guyed sailboat mast. Diagonal struts (not shown) may also be provide between the inner 3 and outer 2 rings.

The mast mounting supports a low loss close cable distance and mounting of the low wind area antenna boxes.

The same antenna aperture is used for both transmission and reception via DPX filters, one per dipole row, which will operate with very low intermodulation products due to the reduced RF transmission powers. This is not practically possible in a traditional antenna installation with 50 W transmitters and high sensitivities, at −116 dBm.

With the antenna panels coupled close to each other in a continuous ring, the following is obtained at the same time. Back lobes are reduced by the eliminated lateral end effect. Back lobes originating through the gridded reflector or around the upper and lower edges meet a continuous second wall reflector giving additional attenuation in the reverse horizontal angles.

A continuous connected self-supporting wheel ring structure requiring few additional wind area and low weight mast mounting rods. These rods are essentially radial and horizontal and are elliptically shaped to have a low Cd, against horizontal winds from all azimuths. The strong ring structure is ideal to support an antenna system with a high antenna aperture W/H factor of 1–20.

Amplitude and phase tapering is used on most radio channels and on ⅓ or ¼ of all horizontal vertically mounted dipole row inputs. In this way a very narrow horizontal lobe with the width of appr. 60°×lambda/W, and with low side lobes and back lobes can be pointed to each user, significantly increasing capacity and link budget and power efficiency.

In FIG. 3 is shown a sector of a phased array antenna to be installed in accordance with the present invention.

The radio tower or mast is complemented with phased array antennas installed together with the existing antennas in order to permit continuous operation of the analog system during the installation of new hardware.

The phased array antenna comprises at least one sector, such as shown in FIG. 3. It is built up on an aluminium framework where 32 dipole antenna elements 10 are arranged in eight vertical rows, each row containing four dipoles 10. At each side of the rows are aluminium rods 8 placed. The aluminium rods 8 are acting as reflectors.

The reflector panel 5 comprises oval horizontal beams and round vertical rods welded together in each crossing. The panel has a joint in the centre so that it may be lacquered and transported in two halves.

Figure 4:
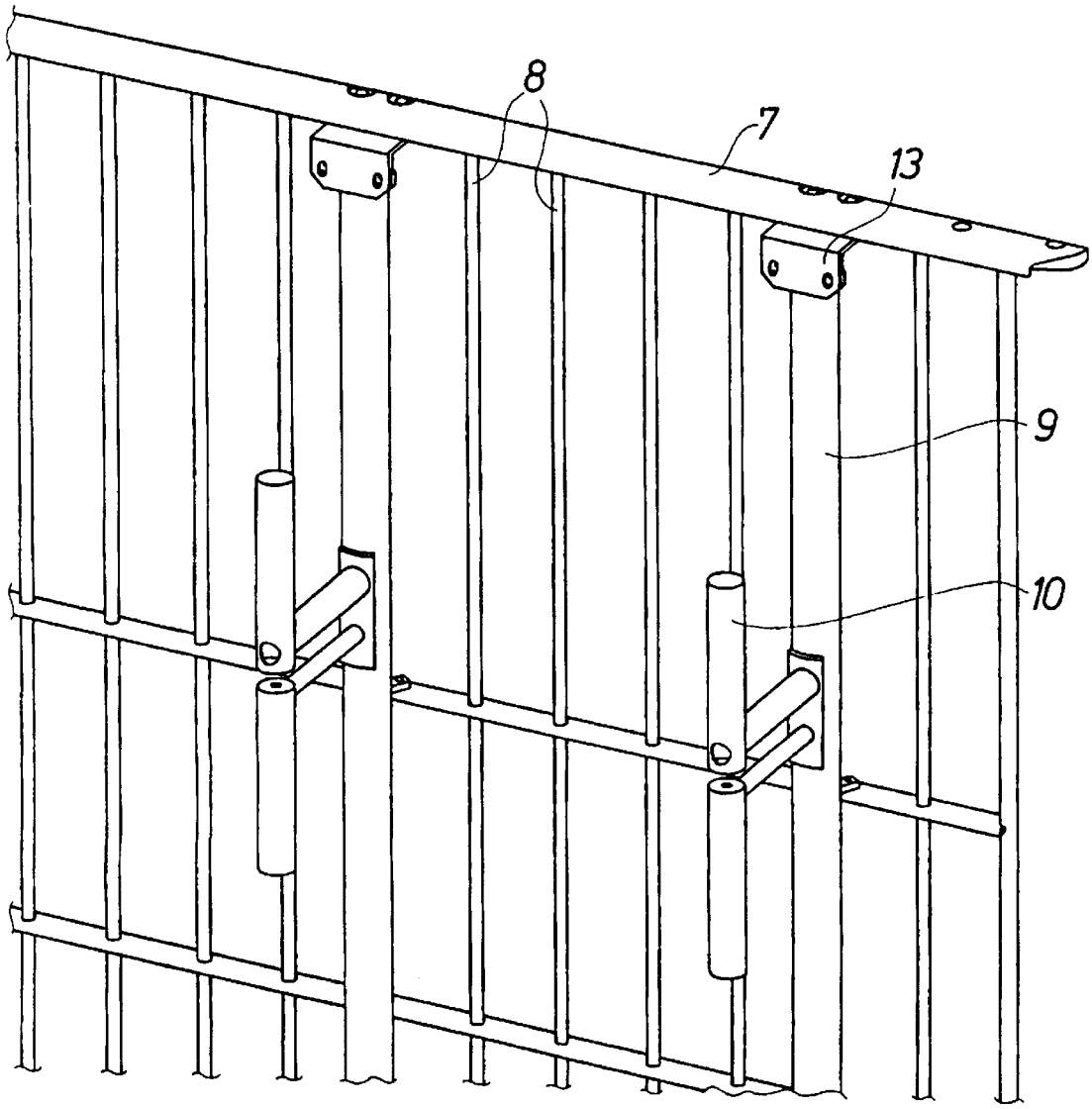
FIG. 4 is a cutaway front view of a corner of the panel of FIG. 3
Figure 5:
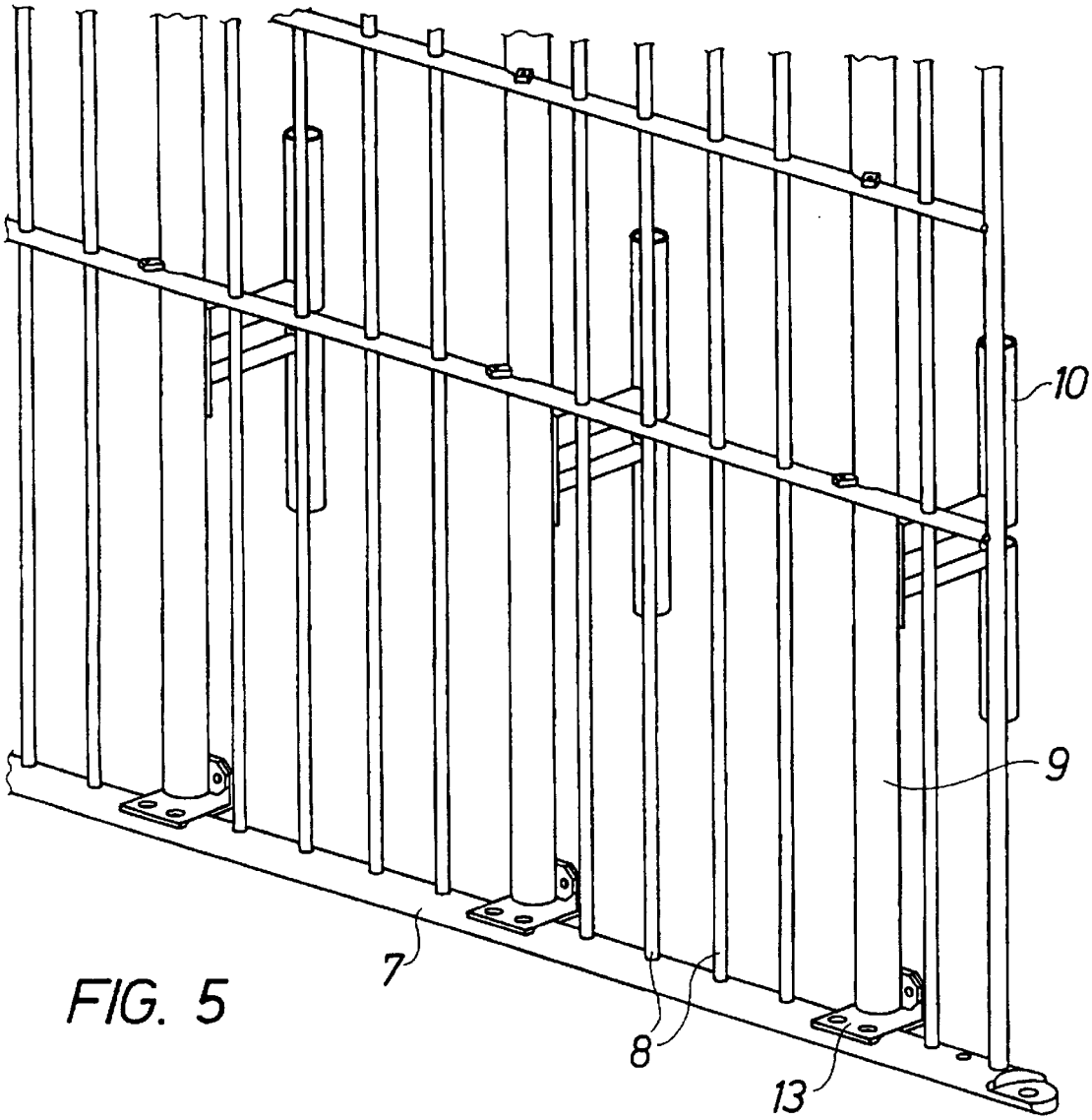
FIG. 5 is a cutaway rear view of a corner of the panel of FIG. 3.

As is shown in FIGS. 4 and 5 the transformer beams 9 on which the dipole elements are welded are fastened with screws to brackets 13 to the horizontal beams 7 of the panels. Thus, it is easy to replace one dipole row for repair or service.

Figure 6:
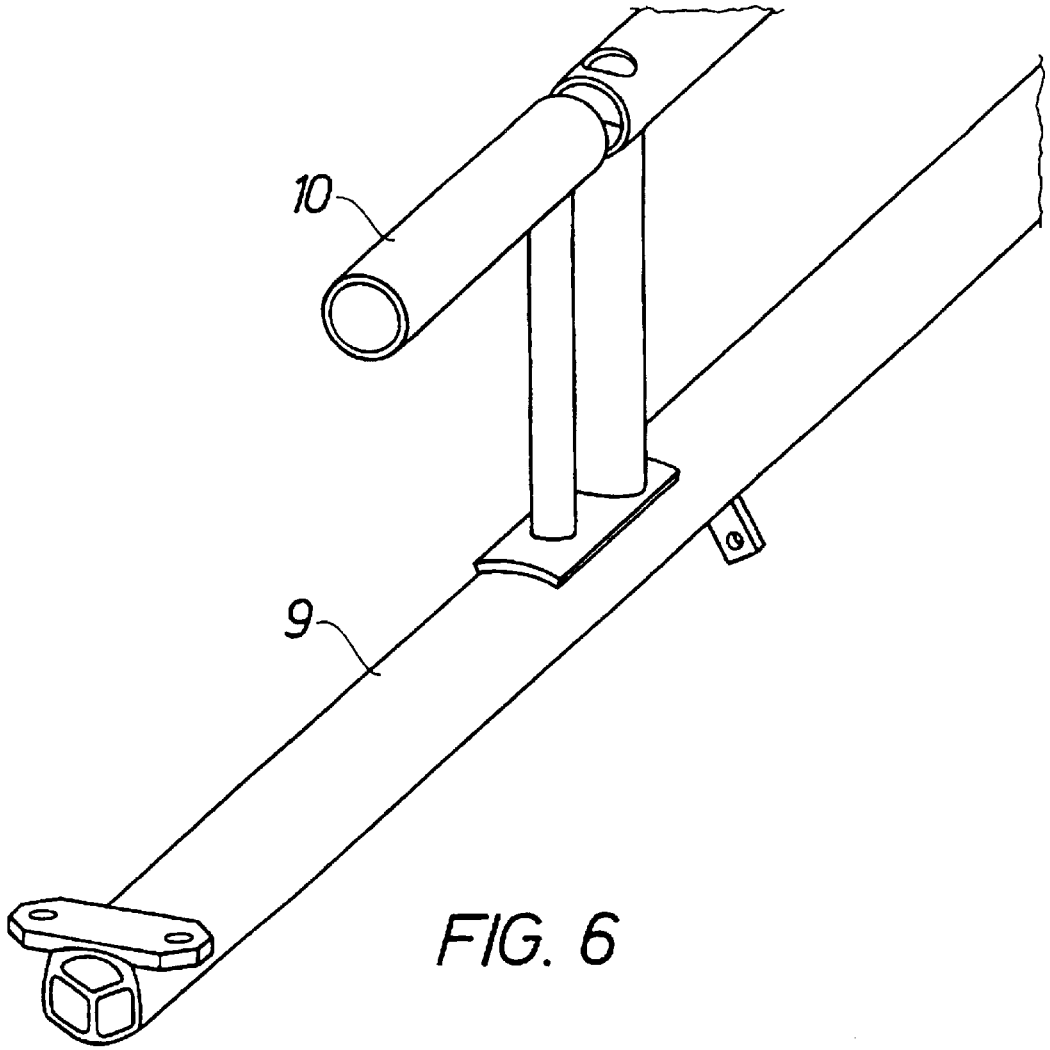
FIG. 6 is a perspective view of a dipole element mounted on a transformer beam of the invention.

In FIG. 6 the transformer beam-9 is seen from the end. The transformer beam has three sections in which brass rods (not shown) are inserted and fixed with plastic distance elements forming three coaxial conductors with the transformer beam as outer casing. The arrangement may also be seen from FIG. 7, in which the sectors are shown with phantom lines.

Figure 8:
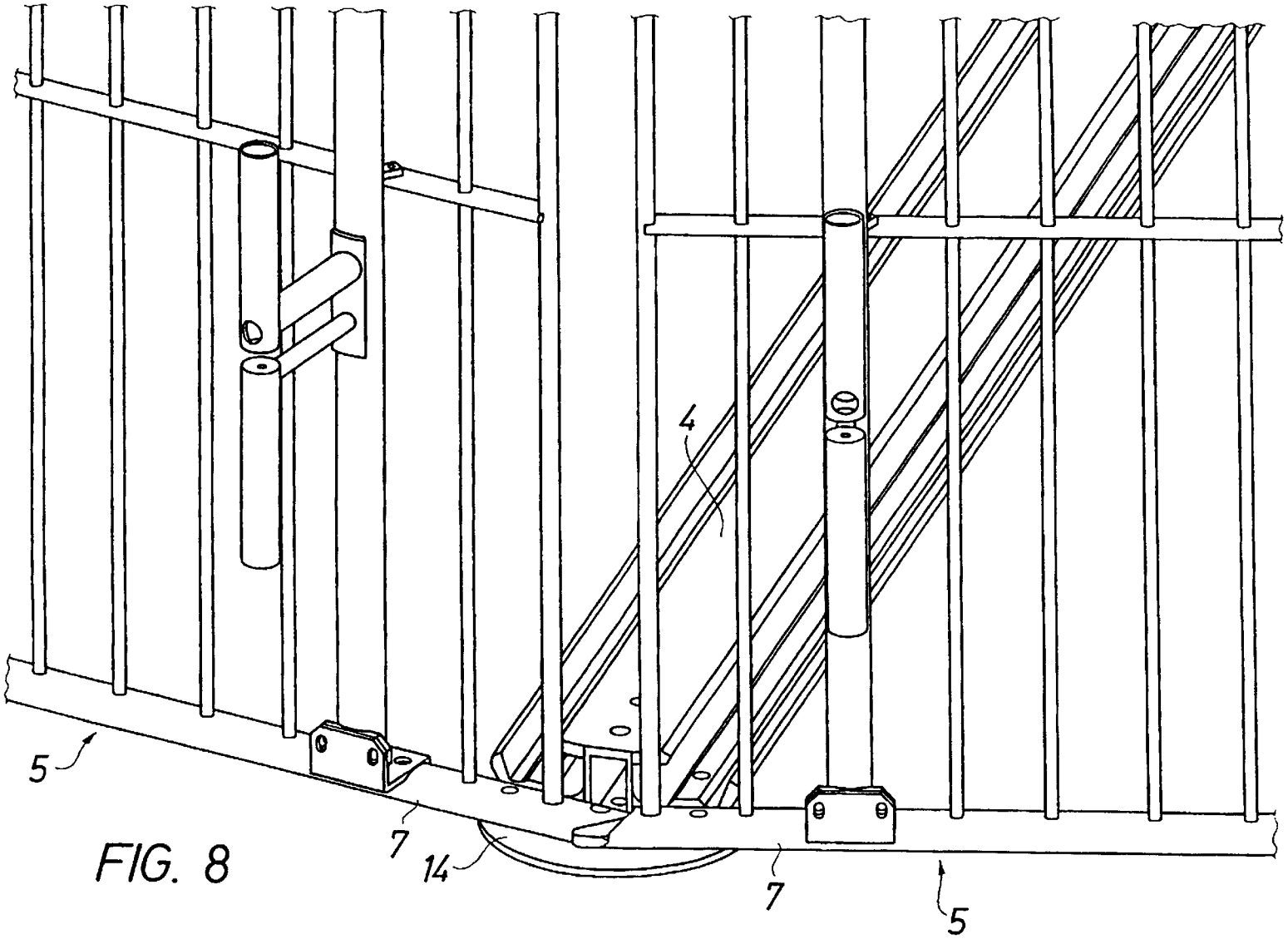
FIG. 8 is a detail view of the lower connection between two panels.
Figure 9:
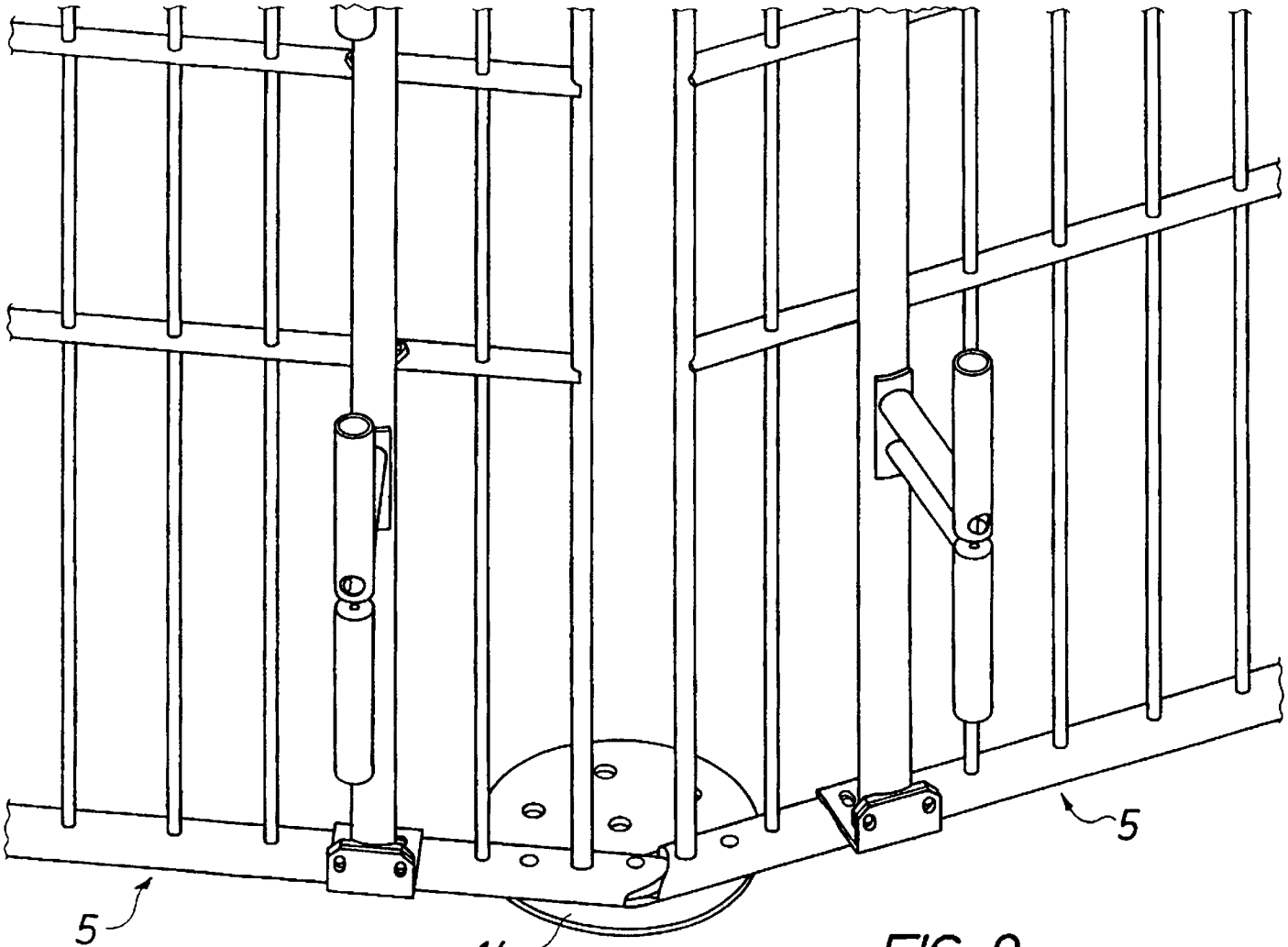
FIG. 9 is a detail view of the lower connection between two panels similar to FIG. 8 but without the horizontal strut.

FIGS. 8 and 9 illustrate how two panels are interconnected at a lower corner. The top and bottom horizontal beams 7 of two panels are overlapping and secured together by a bolt through holes at the end. A connector plate 14 has a hole pattern for bolting the bottom horizontal beams together at a fixed angle. Various connector plates having different hole patterns are provided for different versions of the antenna system having different numbers of panels and, consequently, different angles at the connection. A horizontal strut 4 is also bolted to the connector plate 14. In FIG. 9 the horizontal strut is not shown for better clarity.

Figure 10:
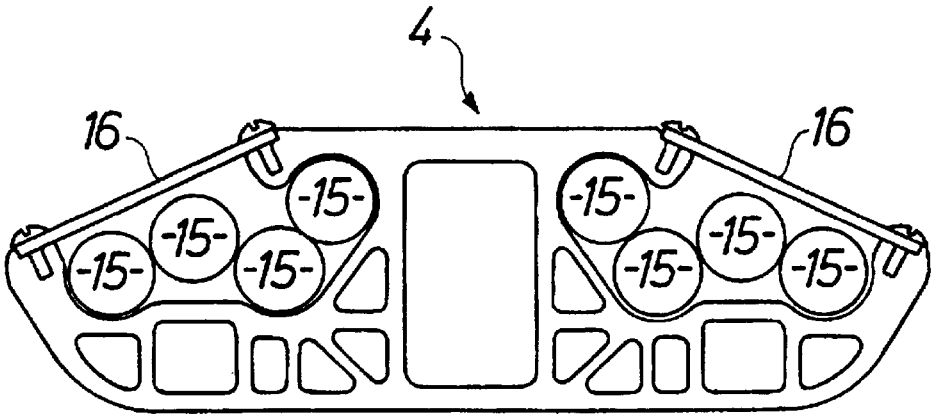
FIG. 10 is a cross-sectional view of the oval horizontal strut.
Figure 7:
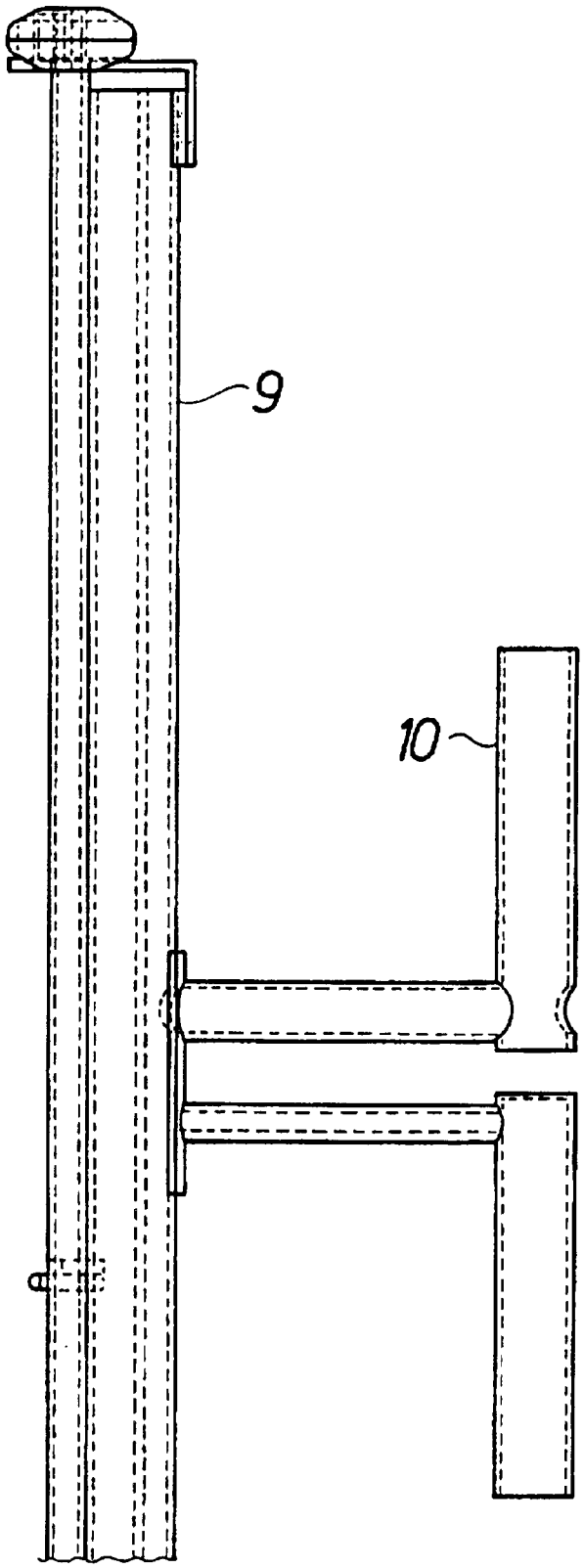
FIG. 7 is a view in longitudinal cross section of a dipole and a transformer beam of the invention.

In FIG. 10 a transverse cross-section of the horizontal strut 4 is shown. At each side, the horizontal strut has a compartment for accomodating a number of cables 15 for feeding the signals to the respective transformer beams. In FIG. 10 four cables 15 are shown at each side. The compartments are covered by a cover 16 fastened with screws to the horizontal beam. The cover 16 may be removed easily for access to the departments for inserting the cables and inspection etc.

Each dipole row are fed in parallel from the lobe shaping unit. The lobe shaping unit is in its simplest form a Butler matrix or similar phase shifting equipment. The lobe shaping unit is shifting the phase of each individual input to the antenna inputs. The phase-shifted signals will when applied to all eight inputs radiate in a combined pattern at an angle from the antenna plane with a main power variable distribution width of about 15°. Each antenna array or sector with eight dipole rows (inputs) can form eight independent lobes. Thus, using a 8 section antenna, 8×8=64 individually controllable lobes are obtained.

Reflector variants are available for the following:

1. Wind loading max. 43 m/s or 60 m/s depending on climatic location
2. Safety factors (SF) 1.1 or 1.3 for rural or populated areas
3. Rural or urban reflector gain versus capacity
4. Rain protection, i.e. plugs and covers
5. De-icing by electric wires or heating fans (not shown) in certain countries and areas The reflector is available in 4 strength variants and reflector densities

| | | |
|---|---|---|
| 60 m/s | SF = 1.3 | Urban capacity |
| 60 | = 1.1 | Rural range |
| 43 | = 1.3 | Urban capacity |
| 43 | = 1.1 | Rural range |

The grid reflector is wideband with fo=450 MHz. Medium or low back lobe electrical versions are available.

The reflector is split in two halves for easy transportation and bolted together.

The rural reflector higher gain variant (not shown) has three rods between the dipole rows giving lowest wind loading supporting a gain increase by more panels installable.

The urban reflector higher capacity variant, such as shown in FIG. 3, has four rods between the dipole rows having lower back lobes and therefore higher capacity.

Vertical rods are circular ø8 or 5 mm having low wind drag and visibility.

A semivisible urban variant with ▭6 or 5 mm solid rods with four rods between dipoles and 50. tighter horizontal 5×25 mm bars.

The dipole rows are available in four bandwidth and frequency variants at SWR<1.3

| | | | |
|---|---|---|---|
| 450–470 BIN | 20 MHz | fo = 460 | D = 12 mm |
| 400–500 | 100 MHz | 450 | D = 25 |
| 380–480 | 100 MHz | 430 | D = 25 |
| 380–512 | 132 Mhz | 446 | D = 30 |

As an alternative, a rural dipole and transformer variant with 1.1 times higher vertical height and gain +0.4 dB at the expense of slightly higher back lobes is provided. This is in combination with only 30 dB first vertical zero fill up.

The dipole elements are available in thick or thin diameters ø25 or ø12 mm, respectively, for 100 or 20 MHz bandwidth.

The transformer beams are of diameter ø29 mm air insulated, or ø20 mm to reduce wind load and visibility, optionally with sleeved humidity insulator (not shown).

Dipoles of aluminium thickness 2–1.8 mm welded to the transformer in one piece without screws for low weight and low nonlinearities as is shown in FIGS. 4 to 7.

Coaxial connectors (not shown) are provided at the bottom or top of the transformer beams.

| | |
|---|---|
| Vertical lobe tilt available | −2, −4, −6 degr. |
| Vertical first zero fill up | |
| available | −30, −25, −20 dB |
| and second zero | −35, −30, −25 dB |
| and first lower side lobe reduced to | <−15, −18, −20 dB |
| and second lower side lobe reduced to | <−18, −21, −23 dB |

Also the dipole rows are transported separately and screwed together at site.

Dipole row mounting principle:

1. Hang on,
2. Snap in,
3. Secure winged nuts!

Obtained by:

Winged nuts on nylon strap

Solid electrical contact surface

The elliptic mast to antenna connection beams 4 are available in four different strength sizes, covered by three different outer dimensions 35×100, 50×175 and 70×200 mm that also can house 8 runs of ½" or ¾" coaxial panel cables 15 reducing cable wind drag and exposure, as is shown in FIG. 10.

The use of a highly directive high gain antenna system will make it possible to use low power transmitters in both up and down link (0,1 W uplink and 20 W peak, 5 W average downlink) which together with a minimum 48 dB fast adaptive power control function in both the uplink and the downlink will significantly improve the link budget and the power balance in the system. This is an important feature which will keep the co-channel interference under control and increase the possibility for channel frequency reuse.

The scanning lobe principle, the low noise amplifiers, the combiner, the base station controller principle and the lobe shaping unit are described more in detail and separately claimed in the above-mentioned patent applications.

New combiners are installed together with a lobe shaping unit and a new base station controller. The combiners will interface existing radio equipment to the new antenna system. Between the antenna array and the combiners a lobe shaping unit will be installed for phase control and lobe forming.

Up to 160 narrow fixed or individual lobes and cells can cover the horizon. This can enable tighter frequency reuse and a capacity increase from 4–64 times, and a RF power reduction of from 4–100 times, both at the base station and the mobile station. This is of very big economical and convenience importance for the end users and the operator.

The open grid circular and elliptic reflector construction gives a wind loading that is typically <25% of a traditional plate and radome dipole antenna, or stripline type, enabling existing masts to be employed.

Another feature included in the design is by optimizing for small cross section aluminium rods of 5 to 29 mm thickness, meaning that >75% of the front area is fully open and transparent. With the rods painted very light grey-white the antenna becomes semivisible or discreet at distance.

Variations

Also a reflector with the same 4 strength and grid densities is available, but with a fixed welded size of H=1220 mm and W=2550 mm. This supports maximised capacity in cities but has 3 dB less gain and is suitable on building roofs. The dipole rows for this smaller antenna are 2 dipoles high, but otherwise the same.

More range gain than capacity gain at 450 MHz can be obtained by: Parallel connected 2 rings vertically by 8 panels ring 1 and 8 panels ring 2. Vertical height=2.6×2=5.2 m. Vertical lobe=14/2=7 degrees Diameter 6.2–6.6 m. Circumference=8×2.6=20.8 m. Only 8 antenna boxes are needed and lower in cost than 16 panels in 1 ring.

The same principles as the vertically polarised antenna above but also with only or both horizontal elliptical dipole rows and closer distance of the elliptical reflector horizontal rods are possible.

This is to give a horizontal diversity polarisation output or input via separate duplex filters.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An antenna system comprising.

a support structure; and an antenna assembly having an open grid reflector structure in a closed ring and dipole elements, wherein the antenna assembly comprises a number of antenna panels, each comprising a number of said dipole elements, the closed ring is self-supporting and connected to the support structure by radial beams and struts, and the antenna panels are interconnected by a variable angle connection.

2. The antenna system according to claim 1, wherein each antenna panel comprises a grid of vertical reflector rods, horizontal support beams, and vertical transformer beams on which the dipole elements are mounted.

3. The antenna system according to claim 2, wherein the horizontal support beams are oval in cross section and the vertical rods and vertical beams are round in cross section.

4. The antenna system according to claim 3, wherein the vertical transformer beams are channeled and include three sectors.

5. The antenna system according to claim 3, wherein electrical equipment is located on a platform inside the support structure or at a lower level.

6. The antenna system according to claim 3, wherein the support structure is an existing radio mast.

7. The antenna system according to claim 3, wherein the support structure is an existing building structure including one of a chimney and a tower.

8. The antenna system according to claim 3, wherein stays are fixed to the antenna panels.

9. The antenna system according to claim 2, wherein the vertical transformer beams are channeled and include three sectors.

10. The antenna system according to claim 9, wherein electrical equipment is located on a platform inside the support structure or at a lower level.

11. The antenna system according to claim 9, wherein the support structure is an existing radio mast.

12. The antenna system according to claim 9, wherein the support structure is an existing building structure including one of a chimney and a tower.

13. The antenna system according to claim 9, wherein stays are fixed to the antenna panels.

14. The antenna system according to claim 2, wherein the closed ring is connected to upper and lower inner rings of horizontal support beams, the inner rings being connected to the support structure by radial beams and struts.

15. The antenna system according to claim 2, wherein the variable angle connection is a connection plate having a hole pattern for bolting two panels.

16. The antenna system according to claim 2, wherein electrical equipment is located on a platform inside the support structure or at a lower level.

17. The antenna system according to claim 2, wherein the support structure is an existing radio mast.

18. The antenna system according to claim 2, wherein the support structure is an existing building structure including one of a chimney and a tower.

19. The antenna system according to claim 2, wherein stays are fixed to the antenna panels.

20. The antenna system according to claim 1, wherein the closed ring is connected to upper and lower inner rings of horizontal support beams, the inner rings being connected to the support structure by radial beams and struts.

21. The antenna system according to claim 20, wherein the variable angle connection is a connection plate having a hole pattern for bolting two panels.

22. The antenna system according to claim 20, wherein each antenna panel comprises a grid of vertical reflector rods, horizontal support beams, and vertical transformer beams on which the dipole elements are mounted, and the horizontal support beams are oval in cross section and the vertical rods and vertical beams are round in cross section.

23. The antenna system according to claim 20, wherein each antenna panel comprises a grid of vertical reflector rods, horizontal support beams, and vertical transformer beams on which the dipole elements are mounted, and the vertical transformer beams are channeled and include three sectors.

24. The antenna system according to claim 20, wherein electrical equipment is located on a platform inside the support structure or at a lower level.

25. The antenna system according to claim 20, wherein the support structure is an existing radio mast.

26. The antenna system according to claim 20, wherein the support structure is an existing building structure including one of a chimney and a tower.

27. The antenna system according to claim 20, wherein stays are fixed to the antenna panels.

28. The antenna system according to claim 1, wherein the variable angle connection is a connection plate having a hole pattern for bolting two panels.

29. The antenna system according to claim 28, wherein a antenna panel comprises a grid of vertical reflector rods, horizontal support beams, and vertical transformer beams on which the dipole elements are mounted, and the horizontal support beams are oval in cross section and the vertical rods and vertical beams are round in cross section.

30. The antenna system according to claim 28, wherein each antenna panel comprises a grid of vertical reflector rods, horizontal support beams, and vertical transformer beams on which the dipole element are mounted, and the vertical transformer beams are channeled and include three sectors.

31. The antenna system according to claim 28, wherein electrical equipment is located on a platform inside the support structure or at a lower level.

32. The antenna system according to claim 28, wherein the support structure is an existing radio mast.

33. The antenna system according to claim 28, wherein the support structure is an existing building structure including one of a chimney and a tower.

34. The antenna system according to claim 28, wherein stays are fixed to the antenna panels.

35. The antenna system according to claim 1, wherein electrical equipment is located on a platform inside the support structure or at a lower level.

36. The antenna system according to claim 35, wherein the support structure is an existing radio mast.

37. The antenna system according to claim 35, wherein the support structure is an existing building structure including one of a chimney and a tower.

38. The antenna system according to claim 35, wherein stays are fixed to the antenna panels.

39. The antenna system according to claim 1, wherein the support structure is an existing radio mast.

40. The antenna system according to claim 39, wherein the support structure is an existing building structure including one of a chimney and a tower.

41. The antenna system according to claim 39, wherein stays are fixed to the antenna panels.

42. The antenna system according to claim 1, wherein the support structure is an existing building structure including one of a chimney and a tower.

43. The antenna system according to claim 42, wherein stays are fixed to the antenna panels.

44. The antenna system according to claim 1, wherein stays are fixed to the antenna panels.

* * * * *